US006289995B1

(12) United States Patent
Fuller

(10) Patent No.: US 6,289,995 B1
(45) Date of Patent: Sep. 18, 2001

(54) ROUGH TERRAIN, LARGE WATER VOLUME, TRACK DRIVEN FIREFIGHTING VEHICLE AND ITS METHOD OF OPERATION

(76) Inventor: Homer M. Fuller, 1521 Covington Ave., Westlake Village, CA (US) 91361

( * ) Notice: Subject to any disclaimer, the term of this patent is extended or adjusted under 35 U.S.C. 154(b) by 0 days.

(21) Appl. No.: 09/452,141

(22) Filed: Dec. 1, 1999

(51) Int. Cl.[7] ..... A62C 27/00

(52) U.S. Cl. ..... 169/52; 169/24; 169/46; 169/54; 239/172; 239/722; 180/6.7

(58) Field of Search ..... 169/24, 46, 52, 169/54; 239/172, 722; 180/6.7

(56) References Cited

U.S. PATENT DOCUMENTS

| | | | |
|---|---|---|---|
| 1,421,496 | 7/1922 | Klewanech . | |
| 3,155,319 | 11/1964 | Hammellmann . | |
| 3,169,581 | 2/1965 | Cummins . | |
| 3,283,828 | 11/1966 | Wehner . | |
| 3,586,236 | 6/1971 | Schaffler . | |
| 3,724,554 | 4/1973 | Rupert et al. . | |
| 3,762,478 | 10/1973 | Cummins . | |
| 3,785,439 | 1/1974 | Britt . | |
| 3,840,074 | 10/1974 | Clark . | |
| 4,194,571 * | 3/1980 | Monte | 169/61 |
| 4,875,526 | 10/1989 | Latino et al. . | |
| 5,113,946 * | 5/1992 | Cooper | 169/24 |
| 5,626,194 * | 5/1997 | White | 169/24 |
| 5,641,024 | 6/1997 | Lopez Alvarez . | |
| 5,860,479 | 1/1999 | LaFollette . | |
| 6,029,750 * | 2/2000 | Carrier | 169/52 |

* cited by examiner

*Primary Examiner*—David A. Scherbel
*Assistant Examiner*—Robin O. Evans
(74) *Attorney, Agent, or Firm*—Dann Dorfman Herrell and Skillman, P.C.

(57) ABSTRACT

A rough terrain, large water volume, track driven firefighting vehicle with tracked running gear for all terrain capability, having a large onboard water tank, a universal nozzle and heat shields cooled by a system of standoff sprinklers behind the shields, a forward spraying sprinkler and an operator's compartment having controls for operating the vehicle.

22 Claims, 11 Drawing Sheets

ROUGH TERRAIN, LARGE WATER VOLUME, TRACK DRIVEN FIREFIGHTING VEHICLE AND ITS METHOD OF OPERATION

FIELD OF THE INVENTION

The present invention relates to a vehicle to control and extinguish wind driven brush fires such as the fires experienced in California during periods of high winds, low humidity and high temperatures, known as "Santa Ana Conditions". More particularly, the invention relates to a vehicle with tracked running gear for all terrain capability, a large onboard water tank, which may be removable for quick turnaround at the refill site, a universal nozzle capable of delivering at least 200 gallons of water per minute 180 degrees in azimuth and 30 degrees up and down and heat shields cooled by a system of standoff sprinklers behind the shields. The vehicle may also be used to fight other fires at close range while protecting the operating crew.

DESCRIPTION OF THE PRIOR ART

Fighting wind driven brush fires in rugged terrain has been proven to be dangerous and difficult to accomplish. Fires of this type have devastated Southern California at least once a decade for many years causing huge losses to property owners and insurance companies as well as injuries and death. Present methods of fighting these fires have proven to be marginal at best, as year after year these fires burn from the San Fernando Valley to Malibu without containment. Present methods of fighting these fires include conventional fire engines with man held fire hoses, helicopters, aircraft and men with picks and shovels. All these methods have proven to be inadequate to prevent the huge losses that have ensued. The helicopter has been marginally effective because it carries only 300 gallons of water which spreads over a considerable area and partially evaporates before reaching the source of the flames. Aircraft tankers carry up to a thousand gallons of water but suffer from the same limitations as the helicopters namely, evaporation and intermittent application of water. Also, both airborne vehicles are limited to daytime operation since flying at night is too dangerous. Fire engines are not all terrain vehicles and must operate on roads and close to fire hydrants. Men with pick and shovels cannot operate close to the fire source safely and can be in danger of death or serious injury in case of sudden wind direction change. Patents have been granted for vehicles that can be operated by remote control allowing the fire fighters to remain at considerable distance from the flames and still apply water directly on the source of the flames. Examples of these patents are U.S. Pat. No. 2,360,397 issued to E. E. Carpenter, U.S. Pat. No. 3,724,554 issued to P. D. Rupert et al., and U.S. Pat. No. 3,762,478 issued to P. F. Cummins. These vehicles may only be effective under ideal conditions, namely having a source of water nearby and long hoses strong enough to feed the vehicle as it attacks the fire in rugged terrain. A fast moving wind driven brush fire would be difficult to contain with these devices due to their limited maneuverability. All of these devices require a source of water connected to the remote control vehicle by long hoses which would be difficult to control in the brush covered less than ideal terrain of Southern California. U.S. Pat. No. 4,875,526 issued to Latino et al. addresses many of the problems of prior fire fighting apparatuses. However, coordinating all three sections of this vehicle, using two operators in separate sections of the vehicle may cause problems in difficult terrain.

Therefore there is still a need for a self contained vehicle that can operate in rugged terrain, applying water directly to the source of the fire, for extended periods of time, with protection for the crew and heat shielded to protect for the vehicle. The vehicle of the present invention will satisfy the above conditions and operate on a 24 hour schedule

SUMMARY OF THE INVENTION

Fulfilling the need for an all terrain fire fighting vehicle that can safely attack the source of a wild fire for an extended period and operate day and night is the purpose of this invention. This purpose is obtained by using a tracked running gear similar to a battle tank carrying a large water tank. For example, a tank of approximately 6,000 gallon capacity, feeding a universal nozzle capable of delivering at least 200 gallons per minute to the base of the flames. Other features of this vehicle are heat shields cooled by a system of standoff sprinklers located between the heat shields and the structure and a forward spraying sprinkler to control flareups.

More specifically the present invention relates to a fire fighting vehicle. The vehicle has a frame and a drive system for the vehicle supported on the frame. Tractor treads are supported from the frame by support means including rotatable drive and idler shafts, rotatable drive shafts being driven by the drive system engine through the transmission allowing separate driving shafts rotatably supported on the frame. An operating compartment for at least one occupant is supported on and constitutes part of the frame. Power control means within the compartment is connected to the drive system and controls power delivered as well as the speed and direction of movement of the respective treads. A water storage tank is supported on the frame. A high volume water nozzle is mounted on the frame such that it permits movement of the nozzle relative to the frame sufficient to cover a fire by movement over a predetermined field. A conduit between the water storage tank and the water nozzle includes a control valve in the conduit having control in the operating compartment.

Advantageously, fixed spray means is also supported on the frame in position to direct a distributed spray in front of the vehicle. A spray connection conduit between the water storage tank and the fixed spray includes at least one control valve in the spray connection conduit.

DESCRIPTION OF THE PREFERRED EMBODIMENT

Figure 6:
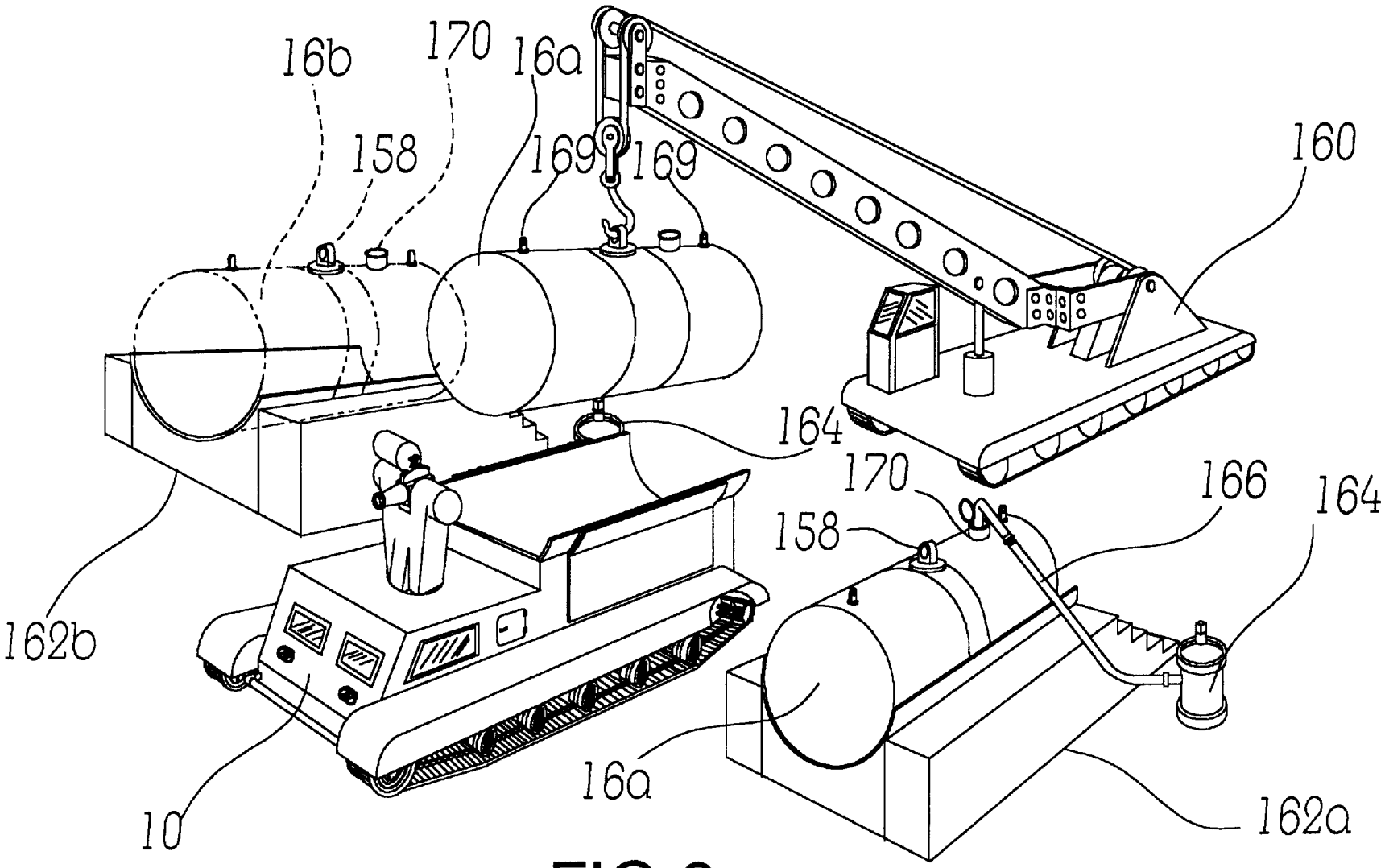
FIG. 6 is an elevated perspective view of the support equipment required to accomplish removing an empty tank from the vehicle and replacing it with a full tank.

Referring to FIGS. 1 to 7 of the drawings, the preferred embodiment of the fire fighting vehicle generally designated 10, includes frame 12, track type running gear 14 a removable tank 16 supported on the frame, universal nozzle assembly 18 supported on the frame. The universal nozzle is capable of delivering at least 200 gallons per min. of water 100 feet ahead of the vehicle and movable relative to the frame 180 degrees in azimuth, and 30 degrees in elevation (up and down). A forward spraying sprinkler system 20 is used to extinguish smoldering embers left in the wake of main wild fires as they are brought under control. Removable straps 22 hold the tank in place in a cradle on the frame 12, but when released permit lifting the tank from and lowering the tank 16 into the refilling cradles by means of lifting fitting 158, as shown in FIG. 6.

Figure 3:
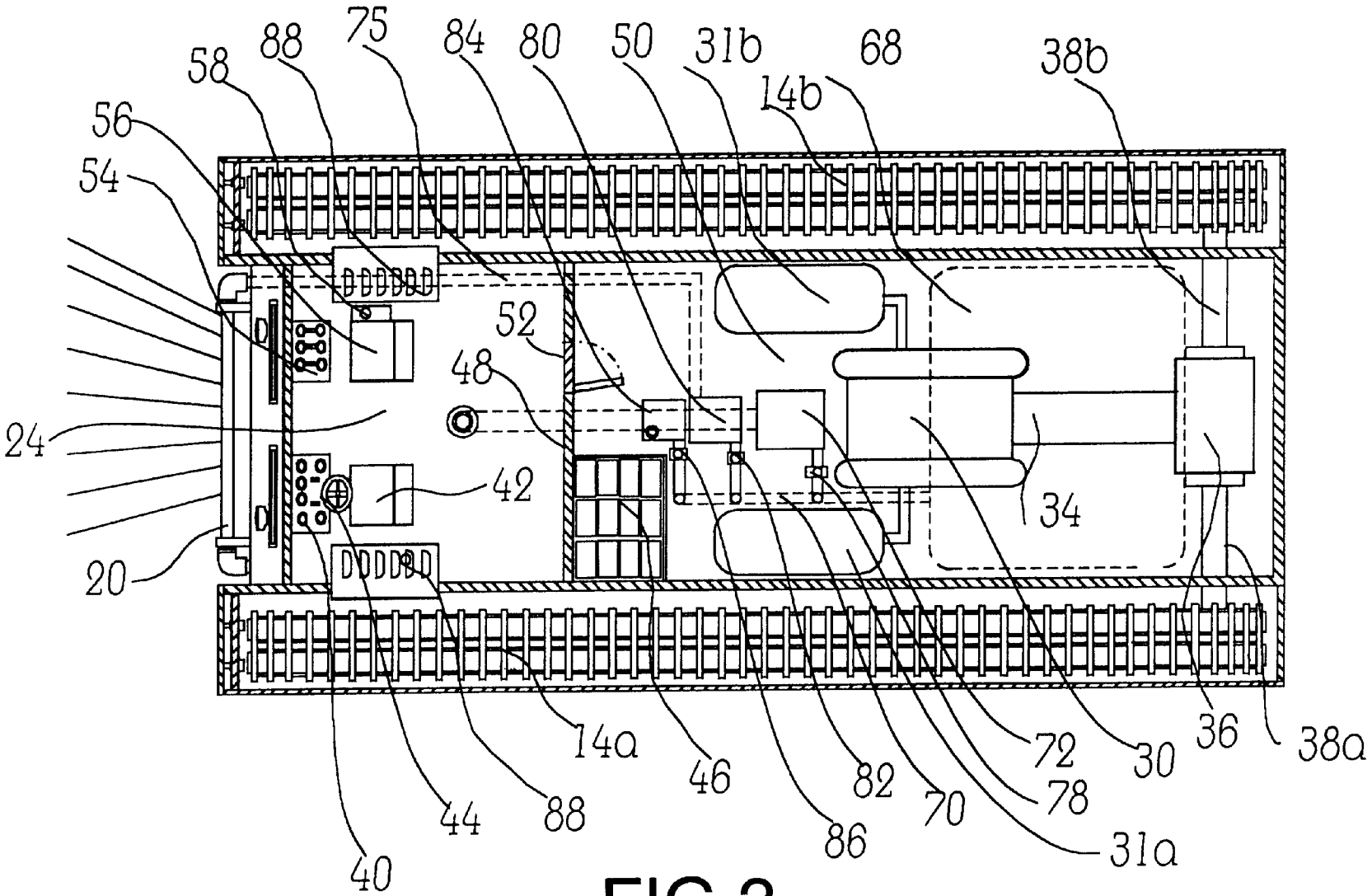
FIG. 3 is a plan cross section taken line 3—3 of FIG. 1 further defining the vehicle's internal components.
Figure 5:
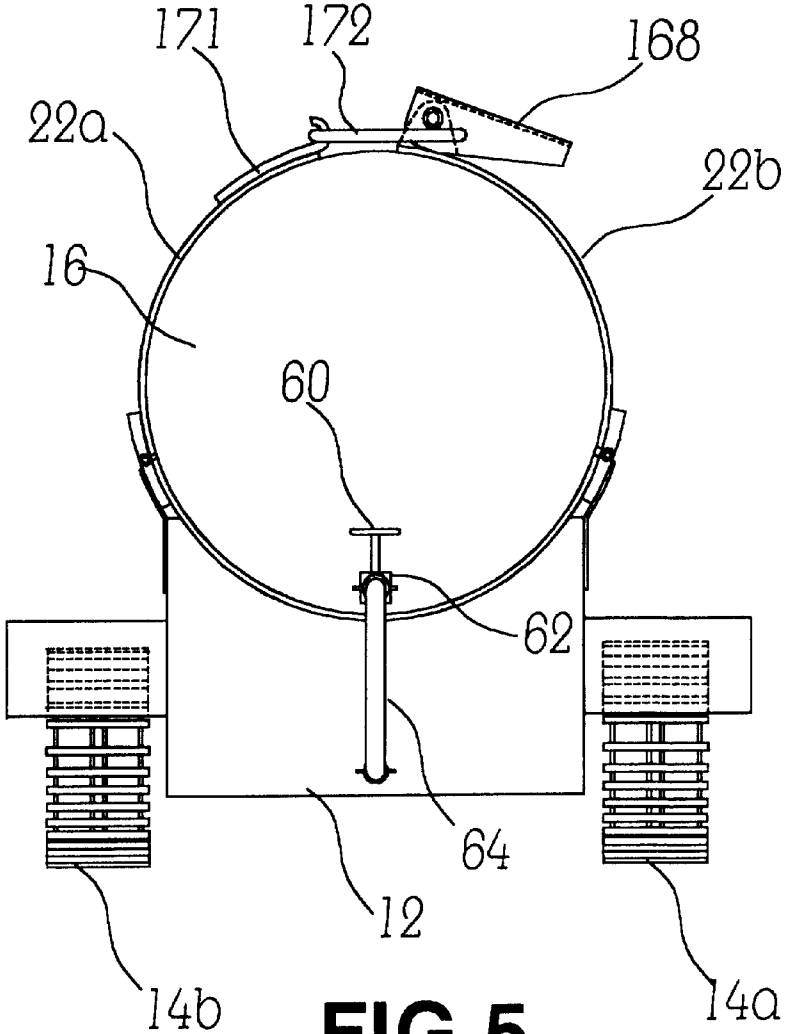
FIG. 5 is an elevational view looking forward from the rear of the vehicle showing the overcenter clamp and the straps that hold the water tank in place and the removable hose and shutoff valve that connects the removable tank to the onboard tank.

FIG. 3 as well as the other overall drawings also show that the frame provides an operating compartment 24 for human operator(s) of the vehicle. An entry door 26 provides access by the operators to the operating compartment. Alternatively, robots within the compartment can be used to remotely control the vehicle to avoid exposure of the operators to the fire. If such an option were used operators could rely on sensors on the vehicle. The windows can be eliminated if the sensors are placed on the outside of the frame to aid the operators in remote control.

As will be explained in greater detail below, the compartment is designed for two operators, one of whom drives the vehicle and the other controls the fire fighting equipment. In other embodiments, a single operator might perform both functions. Both need to see out of windows 28. The track type running gear 14 will give this vehicle all terrain capability allowing it to attack the fire at its source and not be limited to roads. The vehicle will be able to operate at considerable distance from a water source and not be limited by the location of fire hydrants. This vehicle could be supported by tanker trucks located on the nearby roads or by water filling stations of the type similar to that shown in FIG. 6. With a 6,000 gallon water tank 16 delivering 200 gallons per minute and supplying the forward spraying sprinkler and the heat shields 32*a*, 32*b*, 32*c*, 32*d* and 32*e* with water for its cooling system 69, this fire fighting vehicle will be able to stay on station, fighting the fire at its source for approximately 25 to 27 minutes between refillings.

Fire fighting vehicle 10 has a frame 12 which has not been shown in detail but will, in many respects, resemble the frame used for military battle tanks. The frame must be rigid and strong enough to resist bending and twisting forces of the terrain on which it much be used and which will tend to loosen the parts and cause breakup of the structure. Thus the frame takes advantage of the structural design principles well known in rough terrain vehicles such as battle tanks but which need not be considered in detail here. Additionally, insulation (not shown here) should be applied to the inside surfaces of the control compartment. The frame must support the various parts of the system shown in FIGS. 2 and 3 including an engine 30 having a drive shaft 34 to a transmission 36 which, by separate controls, allows the individual output shafts 38*a* and 38*b* to operate at different speeds, if so desired. Sprockets 39*a* and 39*b* to drive the respective treads 14*a* and 14*b* may be adjusted to run at different speeds from one another and in fact run in opposite directions, if desired. Details of variable transmissions for each of the shafts 38*a* and 38*b* are not disclosed but various means are known in the art of driving battle tanks and tractors at different speeds and in fact in opposite directions. For example, it would be possible to have a pair of slide controls, one for each shaft, whose relative positions determine relative speeds of the shafts 38*a* and 38*b* to determine the sharpness of turns. An accelerator or throttle for controlling engine speed is also needed. Whatever controls are provided are in the operator compartment 24. The driving operator sits in seat 42 and has only the driving console in front of him. The driver's console 40 has gages, switches and possibly a throttle, which may alternatively be located on the floor. In this case there is provided a steering wheel 44 which may translate, through a computer, the required relative speeds of shafts 38*a* and 38*b* and their driven treads 14*a* and 14*b* to produce turns as required. Such an arrangement translates more directly to driving a car and requires less training of the driver. A starter button or ignition key, like those commonly used on automobiles may also be included at console 40. The batteries 46 needed to start vehicle and supply power for other purposes are in a utility compartment behind the wall 48 and beneath the tank supporting cradle. Thus, the utility compartment has a very low clearance below the tank but in case it must be accessed during use, and in any event for maintenance purposes, a door 52 is provided in panel 48. Panel 48 should be an insulated fire wall and the door 52 should be likewise insulated and tightly sealed to the panel when closed.

Similarly, there is a console for the fire controller through which valves may be opened and closed to control the various water distribution systems. The fire controller sits at seat 56 and has at his right hand a joystick 58 which acts to control both the azimuth and elevation of the universal nozzle. Single controls to move a device like the main nozzle are available to simplify what would otherwise require separate controls for azimuth and elevation movements.

Figure 2:
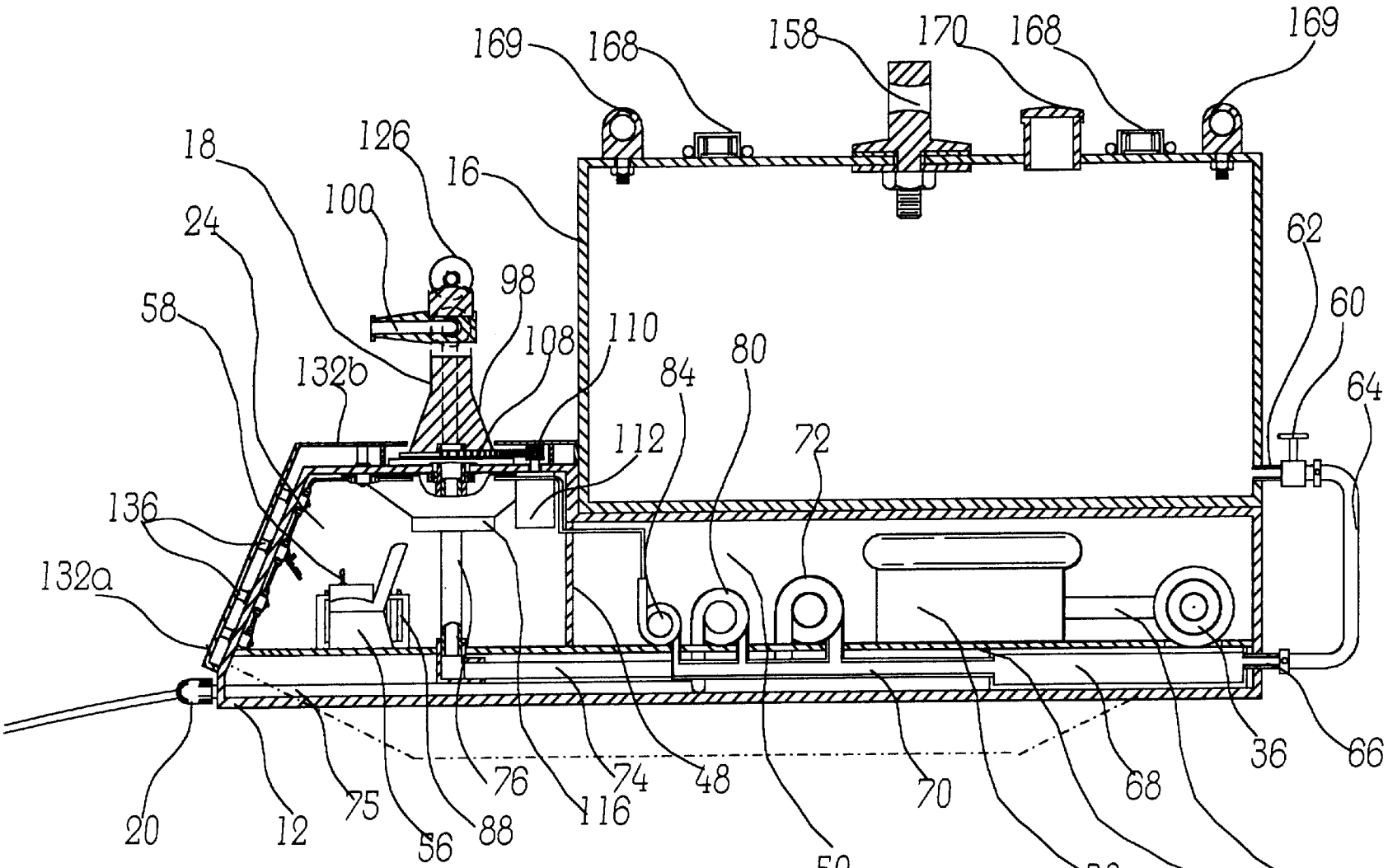
FIG. 2 is a cross section taken along line 2—2 of FIG. 4 showing the internal arrangement of the components that operate the various systems that drive the vehicle and supply the pressure to the three main firefighting systems namely the universal nozzle, the forward spraying system and the heat shield cooling system.

FIG. 2 and FIG. 3 show the utilities compartment 50 and show the internal arrangement of major components of vehicle within that compartment such as the engine 30 which ultimately delivers power to the transmission 36 for controlling the drive shafts 38*a* and 38*b* to respective tracks 14*a* and 14*b* and permitting maneuverability. The structure and nature of the treads 14*a* and 14*b* and their support structures and connection to the frame is illustrated schematically. It will be understood that structures used in military tanks or tractors may be employed. In addition to the drive sprockets 39*a* and 39*b* at the rear of the vehicle, and in the front idler sprockets 21*a* and 21*b* rotatably supported on shafts from the frame, at the front of the vehicle, broadly define the range of the track path. Other guide and path defining members are rotatably supported on the frame or supported on intermediate linkage, spring and shock absorbing structure, generally designated 43*a* and 43*b*, that allows the track members 14*a* and 14*b* to absorb shocks and conform to the terrain during its passage through the lower portion of the track path.

Figure 4:
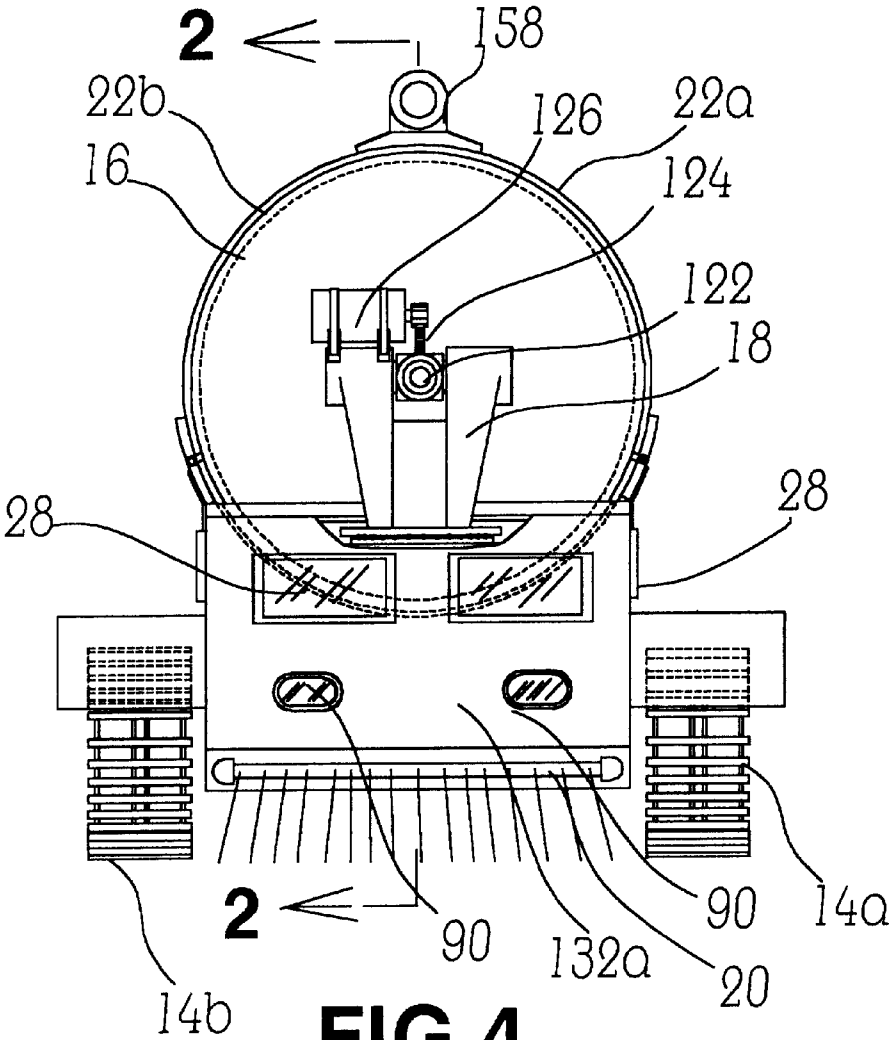
FIG. 4 is a front elevation view of the vehicle, with the horizontal heat shields omitted for clarity, showing the universal nozzle with its vertical drive motor and its ball bearing platform which assists in its azimuth capability.

FIG.4 illustrates the front configuration of the vehicle. The front and side windows 28 provide visibility for the operators and by the use of double panes of quartz with an air space between the panes, insulate the operating compartment 24 from the extreme heat of the fire. Headlights 90 with quartz lenses are provided to assure visibility at night when helicopters and aircraft cannot be used to fight fires.

The main water tank 16 has a valve 60 connecting the tank through a pump 72 to the main nozzle assembly 18. Pipe 62 is connected to the low point of the tank by connecting hose 64, which in turn connects to the inlet 66 of holding tank 68. Holding tank 68 is at the very bottom of the utilities compartment 50. Tank 68 has an outlet manifold 70 which connects to various distribution systems. Manifold 70 connects tank 68 to main water pump 72 which in turn has a pipe connection outlet 74 running beneath the floor of the compartments to a stationary vertical standpipe 76 which as seen in FIG. 2 leads to the nozzle assembly 18. A control valve 78 in the inlet to pump 72 may be opened to permit water to be pumped by pump 72 from tank 68. A solenoid valve is preferably used and controlled by a switch at control panel 54. Similarly, water is distributed to the stationary sprayer 20 through plumbing connection 75 back to pump 80. The pump 80 connection from the manifold 70 is controlled by the solenoid valve 82. A further pump 84 has a connection to a network of plumbing feeding heat shields cooling nozzles described below. Pump 84 is connected from manifold 70 through a solenoid valve 86. Solenoid valves 78, 82 and 86 are controlled by switches at control panel 54. While fighting fires, the human operators are kept cool by air conditioning units 88 which derive their operating power from the batteries 46 and the power supply including a generator driven by the motor 30 or other moving parts (not shown) deriving power therefrom.

Figure 8:
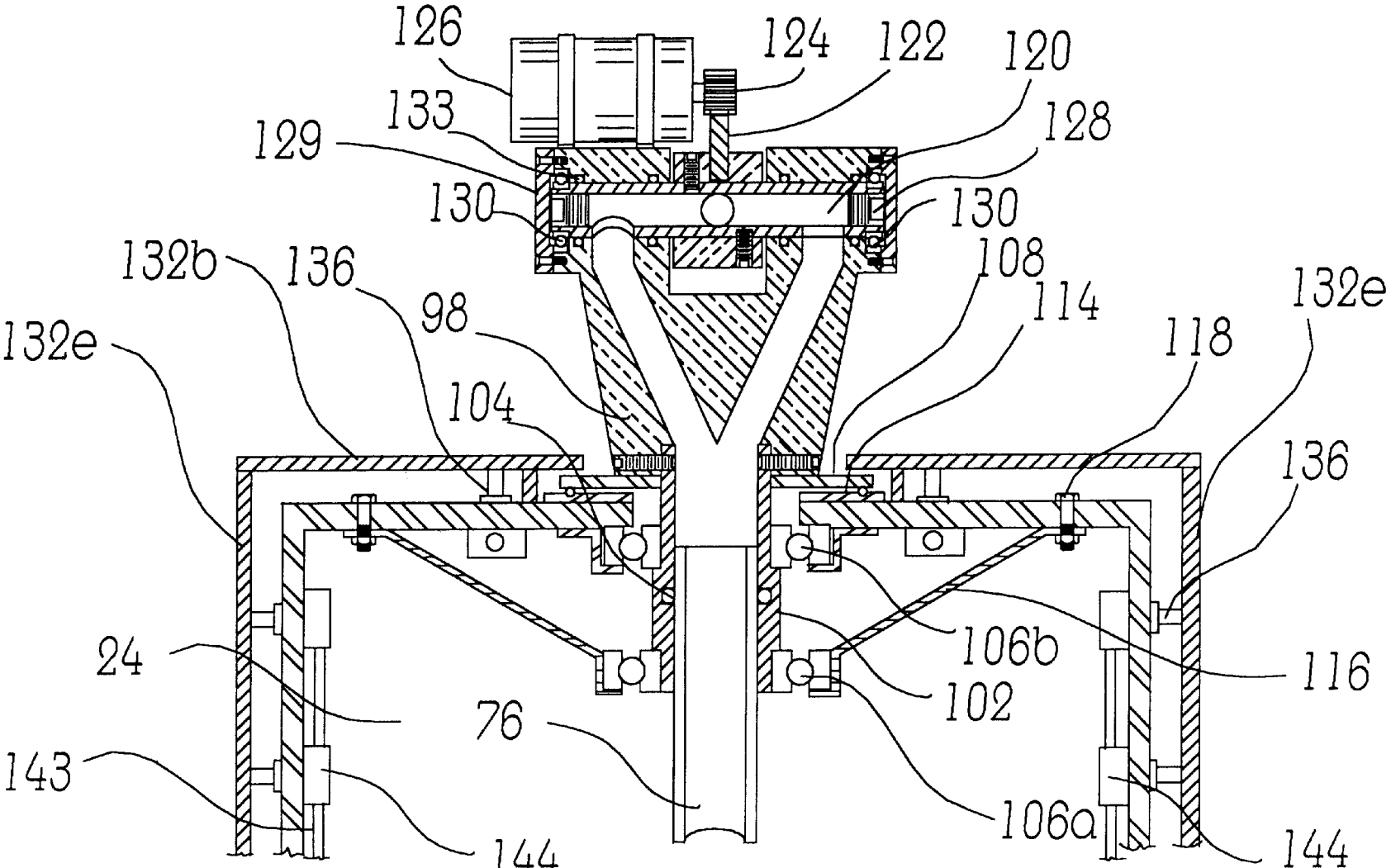
FIG. 8 is an enlarged section view taken along line 8—8 in FIG. 1 of the upper portion of the operating compartment defining the details of the universal nozzle and the heat shields.

The pump 72 feeds water from the auxiliary tank 68 to the universal nozzle assembly 18 through a series of pipes 74 and 76 to the distribution system shown in FIG. 8 which allows for the rotation of the universal nozzle assembly 18.

Figure 1:
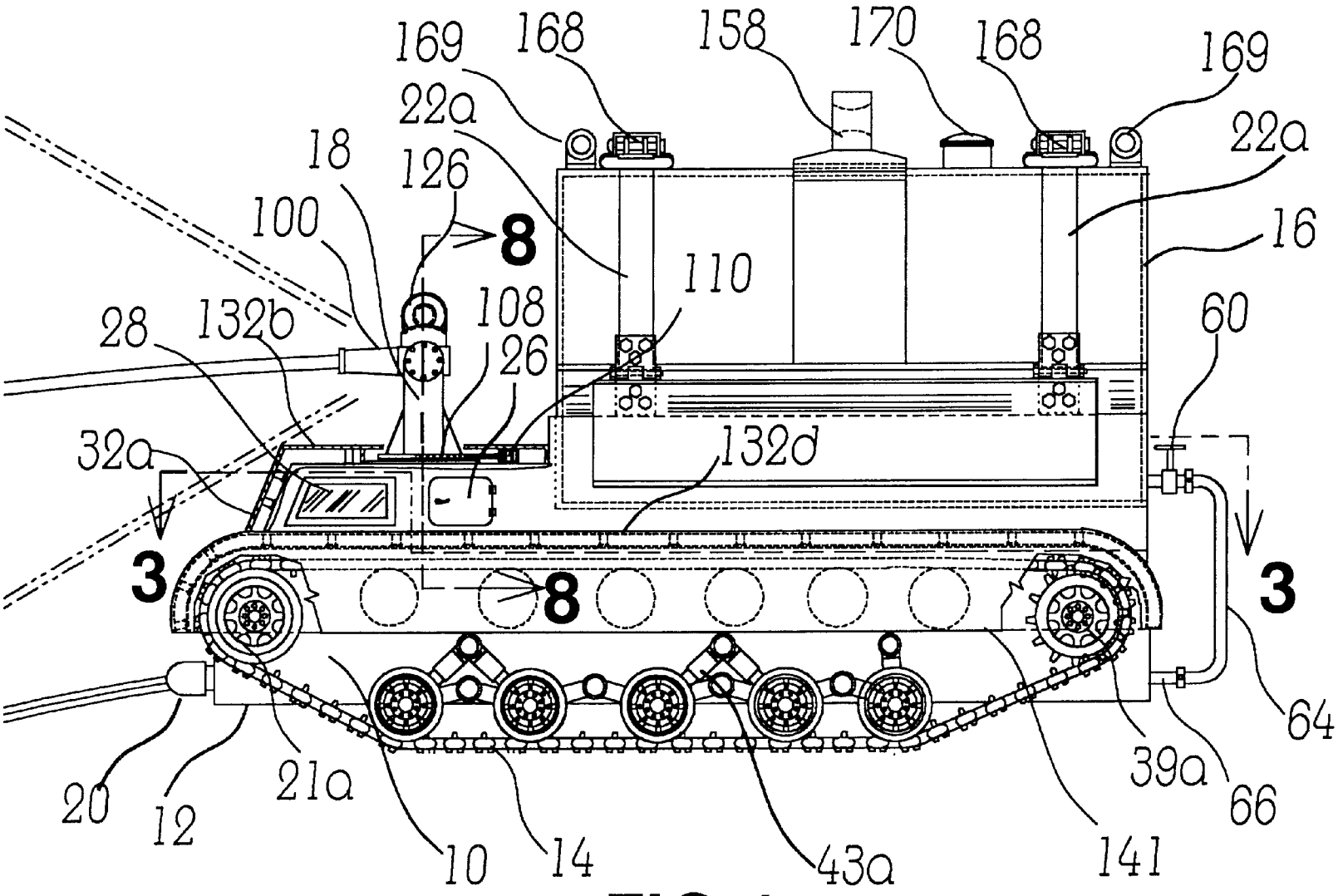
FIG. 1 is a left hand elevation view of the firefighting vehicle, illustrating the all terrain, tracked running gear, the forward spraying sprinkler, the universal nozzle and the removable tank.

FIGS. 1 and 2 show the nozzle assembly 18 in elevation and in section, respectively. FIG. 8 illustrates the universal nozzle assembly 18 by means of a cross section of the upper area of the operator compartment 24, showing particularly relative rotatable parts and their drives as well as the flow channels to the nozzle 100. Water from the main water system pump 72 is introduced into the universal nozzle assembly 18 through pipes 74 and 76 which are stationary and through a housing 98 rotatable about a vertical axis and extending through a hole in the roof of compartment 24. Housing 98 has an axial cylindrical recess terminating in a shoulder at its upper end. Tubular bearing support 102 fits snugly within the recess and seats against the shoulder and is held in place by radially directed screws through the bearing support and the housing 98. The inside cylindrical surface of tubular bearing support 102 fits snugly over vertical pipe 76 but permits relative rotation therebetween around a vertical axis. An O-ring 104 is received in an inward facing groove in the inside cylindrical surface of the bearing support 102 and seals against the outer surface of pipe 76 in order to prevent leakage into compartment 24. The larger diameter center of tubular extension 102 terminates in shoulders which index the bearings 106*a* and 106*b* supported on the smaller diameter portion of extension 102. The housing 98 is attached at a bottom flat surface to the drive shaft of azimuth drive system gear plate 108 which has gear teeth along its outer edge. Gear plate 108 is engaged by a pinion gear 110 axially mounted on the shaft of motor 112 (see FIG. 2) to cause the universal nozzle assembly 18 to rotate about a vertical axis. The platform bearing 114 is provided by balls in a grooved race in a plate on top of the compartment 24 and a similar race in the gear plate 108. This bearing, the thrust bearing 106*b* and the radial bearing 106*a* take the loads generated by the pressurized flow of water through the main water system as well as gravity. The bell housing 116 fixed to the frame at the ceiling of compartment 24 by the shear bolts 118 takes the rotary loads generated by the jet stream out to the frame through the shear bolts 118. Water flows through the housing 98 dividing into two streams fed into each end of the cross tube 120,converging at the middle and exiting therethrough the bore of the nozzle 100 are fixed together and are rotated up and down by an integral gear segment 122 driven by a pinion gear 124 on elevation drive motor 126. Electric motor 126 is controlled by the fire controller by means of his hand control joystick 58. Bearings 130 assist in the rotation and 0-rings 132 seal the universal nozzle assembly 18 against leakage during relative rotation of the nozzle 100 and its unitary structure relative to the housing 98.

Figure 7:
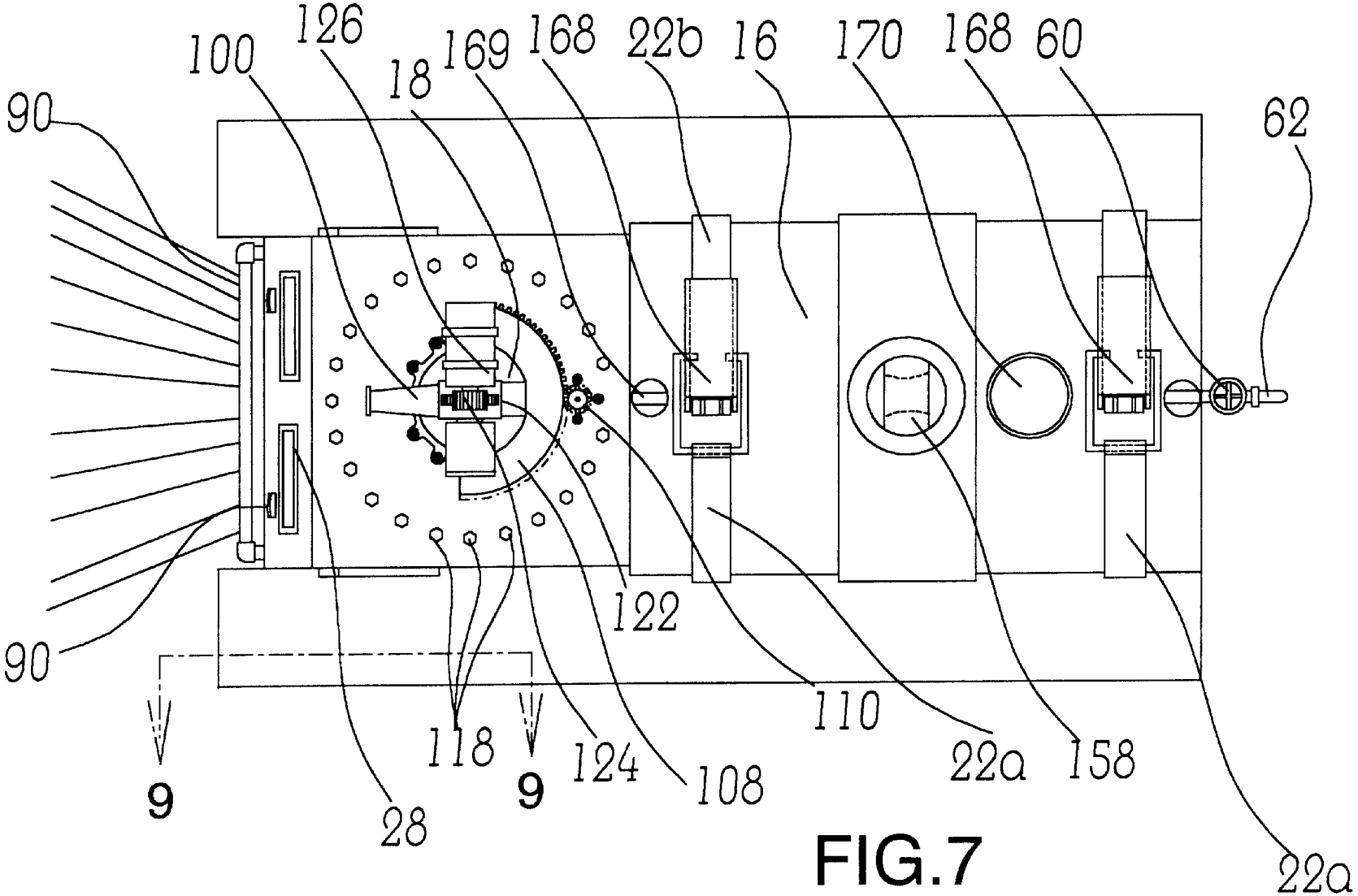
FIG. 7 is a plan view of the vehicle from above showing the arrangement of the exterior components with heat shields over the operators compartment removed to clarify the drive system of the universal nozzle.

FIG. 7 is a plan view of the exterior of the vehicle showing , in particular, the gearing of the azimuth drive system and the vertical drive system for the universal nozzle assembly. The heat shielding has been omitted in this area to reveal these details. The other views illustrate the position of the heat shields when functioning.

Heat shields are of importance to fire fighting vehicles of the type that is described. They help to cover areas which are directly exposed to the heat of the fire with the idea of keeping occupants of the operating compartment 24 as comfortable as possible under the circumstances. They also protect the upper part of the tractor treads covered by fenders securely fixed to the structure to allow their use as access platforms for people entering the compartment 24 or maintaining the vehicle. Not all views show heat shields because they may obstruct other structure that needs to be described. But FIGS. 1, 2*a*, 9*a*, 10, and 10*a* all have to do with the heat shields or the related structure. For example, a heat shield generally conforming to the shape of the operational compartment 24 is included. The front wall has heat shield 132*a*. Heat shield 132*b* conforms to the roof of compartment 24. Sidewalls of the compartment are covered by heat shields 132*e*. Openings in the heat shields are provided for windows 28 and headlights 96 as seen in FIG. 4. The double construction of the floor 134 seen in FIG. 2 provides a space accommodating the auxiliary water tank 68 and plumbing to and from the various pumps but also a heat shielding space.

Figures 10, 10A:
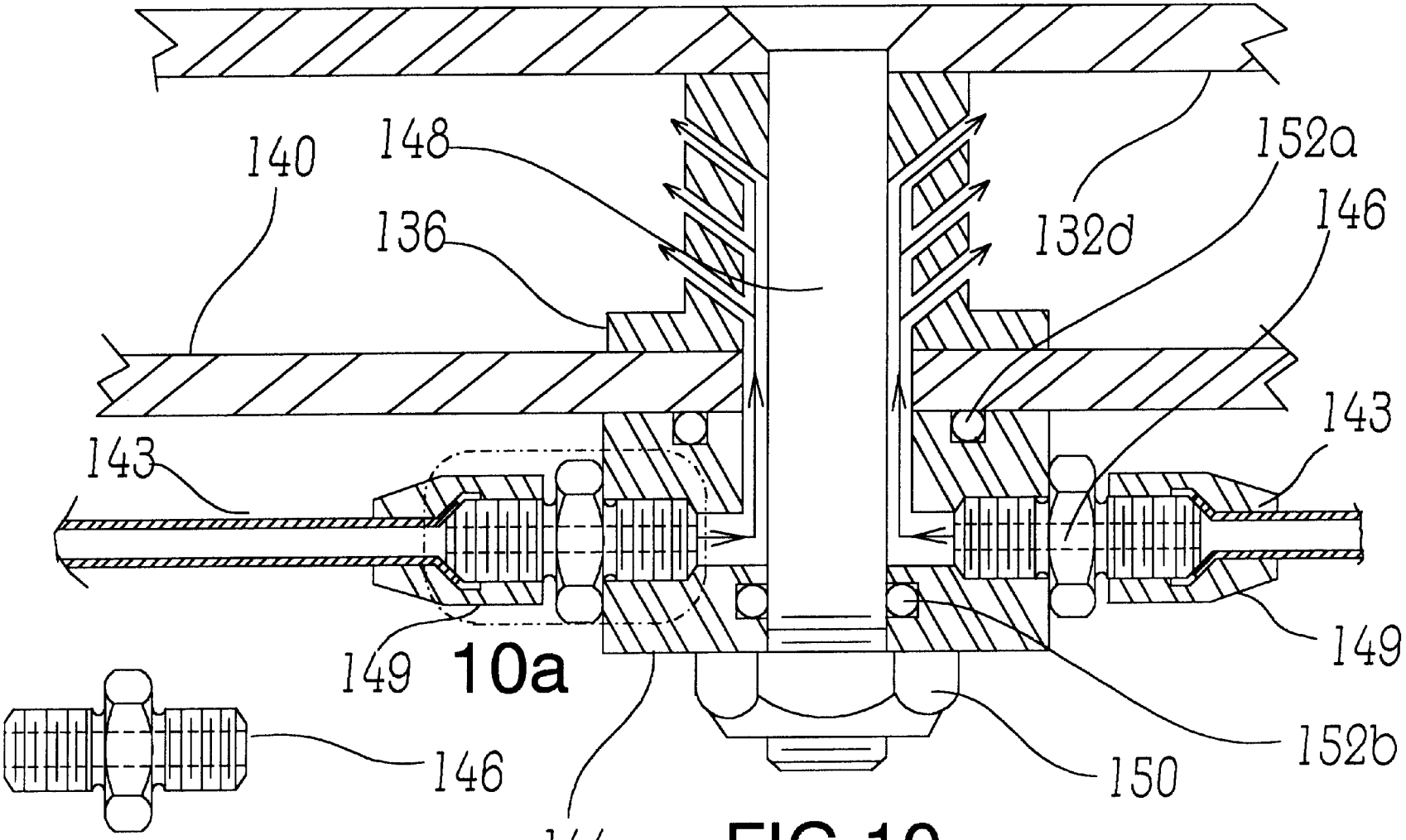
FIG. 10 is an even greater enlargement in cross section of the standoff sprinkler and its manifold in the dashed line enclosure of FIG. 9 labeled FIG. 10.
FIG. 10*a* is a view solely of AN 815 nipple to clarify the part connecting the conduit to the manifold. The AN 815 nipple is one piece and is within the dashed line enclosure in FIG. 10.

The heat shields preferably are spaced from the structure which they cover and protect using standoff sprinkler 136 seen in FIG. 10. The standoff sprinklers are designed to provide ducts and spray nozzles.

Figure 9:
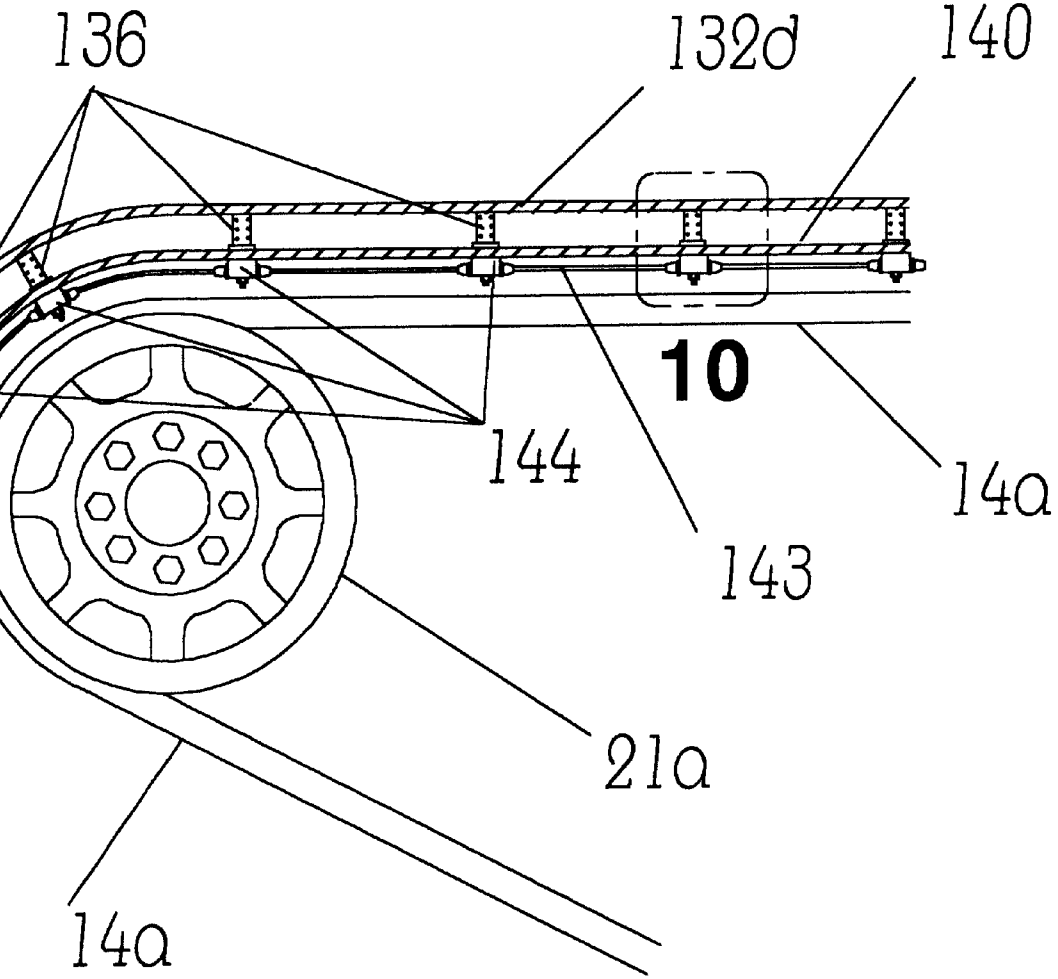
FIG. 9 is an enlarged partial sectional view taken along line 9—9 FIG. 7 showing the standoff sprinkling system in the fender of the vehicle.

FIG. 9 shows heat shield 132*d* for the track fender 140 which cover the tops and extend around the ends of the track and are also brought part way down toward the ground. A lateral cover 141 may be detachable for access to the track support structures. Cooling water distribution systems generally designated 143 extends inside the compartment 24 and beneath the track fender 142. FIG. 9 shows a typical arrangement of the standoff sprinklers 136, their manifolds 144 and the piping system that feeds the standoff sprinklers as specifically applied to the fender heat shield.

Figure 9A:
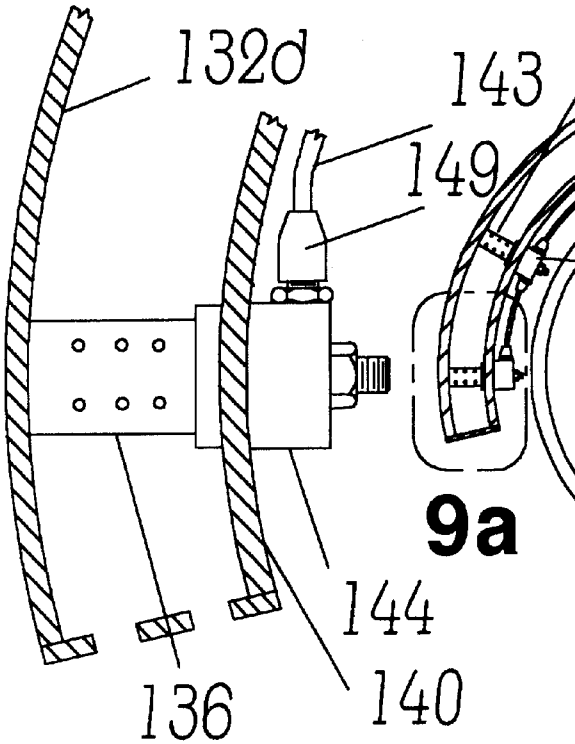
FIG. 9*a* is a further enlargement of a region labeled FIG. 9*a* showing a manifold and standoff sprinkler within the dashed line enclosure of FIG. 9.

The heat shield piping system is connected to pump 84 which is supplied water under pressure to feed the matrix of standoff sprinklers 136. FIG. 9*a* is a detail of a sprinkler at one end of the system. FIG. 10 is a greatly enlarged axial section of the standoff sprinkler 136, the manifold 144 and the piping 147. The standard plumbing fittings (known as a nipple) 146 with their couplings 149 as shown in FIG. 10. FIG. 10*a* shows a view of the standard nipple 146 as it is produced by the manufacturer. The flow of water is indicated in FIG. 10 by the arrows. The manifold 144 and the standoff sprinkler 136 are held in place by a standard stainless steel counter sunk bolt 148 and nut 150. Sealing of the manifold 144 to the fender 140 and bolt 148 is accomplished by 0-rings 152*a* and 15*b*.

The main water tank 16 is removable so that it can be replaced with a full tank without delaying the return of the fire fighting vehicle to the fire site. FIG. 6 is a somewhat schematic perspective view of a fire fighting vehicle with a removable tank at a refill and replace station and the equipment required. A crane 160, capable of handling a load in excess of 30 tons will be required to support this operation. Preferably the crane is portable and hence movable to a fire location where needed. Two cradles 162 are located adjacent to water sources, shown as hydrants 164. Fillings hoses 166 are required sufficiently long to reach the tank filling point 170. Preferably a hydrant for each cradle is provided as shown. Otherwise, a long hose sufficiently to serve both cradles will be required.

Figure 11:
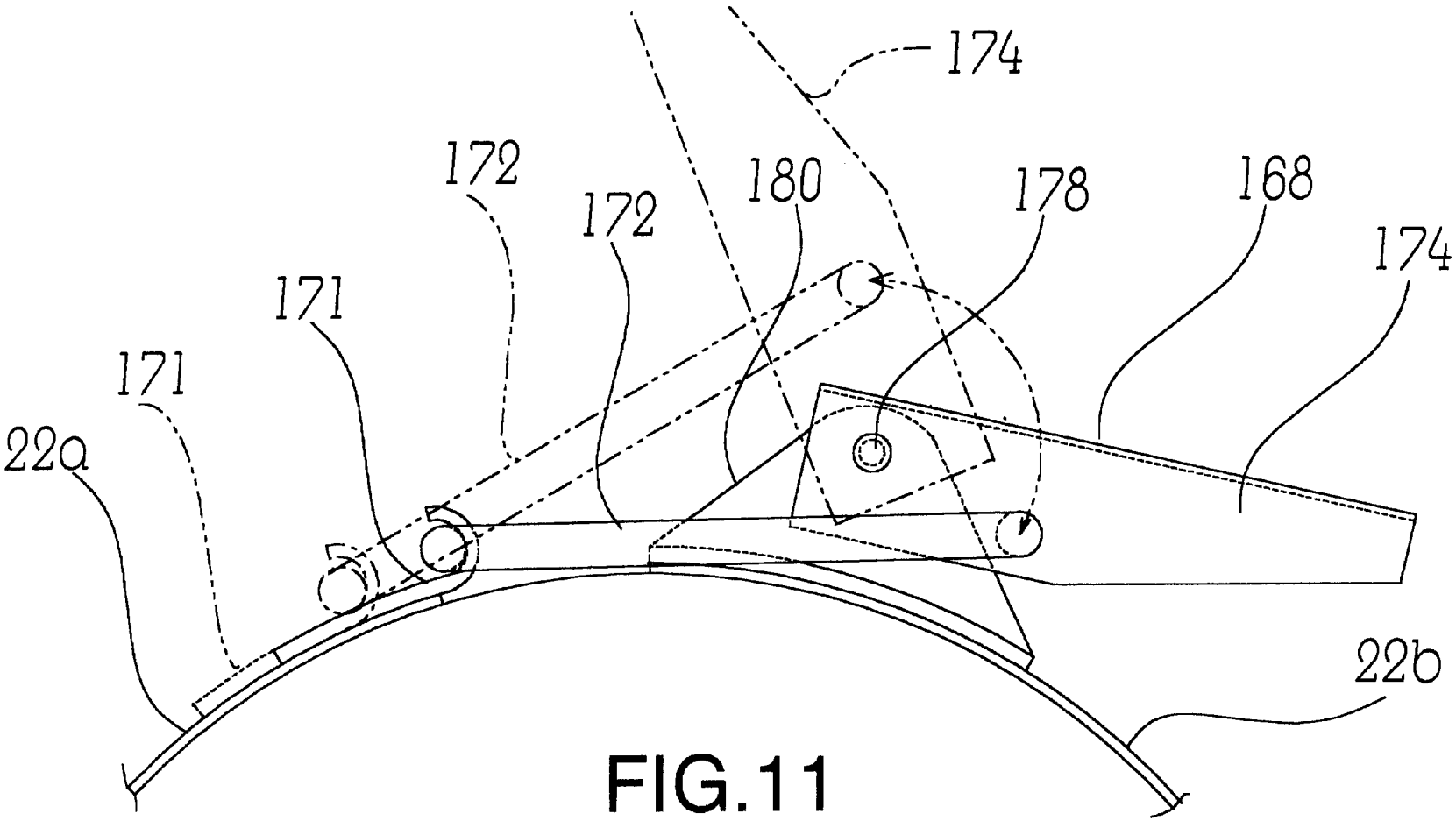
FIG. 11 is an enlarged side elevation view of the over-center clamp.

The procedure of "refill and replace," is as follows: the vehicle 10 is positioned, as shown, between the two cradles 162*a* and 162*b*. The overcenter clamps 168 shown in FIG. 11 are released and straps 22*a* and 22*b* are removed. The valve 60 is shut off and the hose 64 is disconnected from the tank. The crane 160 then lifts the empty tank 16*a* from the bed of the vehicle and positions it in cradle 162*a*. Ropes (not shown) are fed through positioning fittings 169 at the top of each end of the tank to assist human handlers in the positioning operation. The refilling of the now empty tank 16*a* begins at once from the hydrant 64 through the fillhose 166 into the tank 16*a* by way of the filling port 170 so that tank 16*a* will be ready when the next fire fighting vehicle appears. The crane 160 then turns to pick up the full tank 16*b*, shown in phantom and deposits it on the vehicle, as shown. Straps 22*a* and 22*b* are reattached, the hose 64 is reconnected and the valve 60 is opened. The vehicle is then ready to return to the fire and resume its fire fighting task.

FIG. 11 is an enlarged detail view of an overcenter clamp 168 located at the ends of strap parts 22*a* and 22*b* to secure the removable tank 16 in place in the cradle on the vehicle. The hook 171 at the end of strap 22*a* is engaged by the loop 172 which is a part of the overcenter assembly attached to end of strap 22*b*. The ends of loop 172 hook into holes in the side walls of a channel shaped toggle lever 174. The lever 174 is rotated about pin 178 which is part of base channel 180 attached to the end of strap 22*b*. In so moving hook 171 is pulled with its strap 22*a* toward strap 22*b* until the straps stretched and are pulled out so that they snugly engage the tank as the lever 174 moves overcenter of pin 178. By this operation the tank 16 is secured in place. Overcenter clamps of this type are manufactured by several suppliers.

Figure 12:
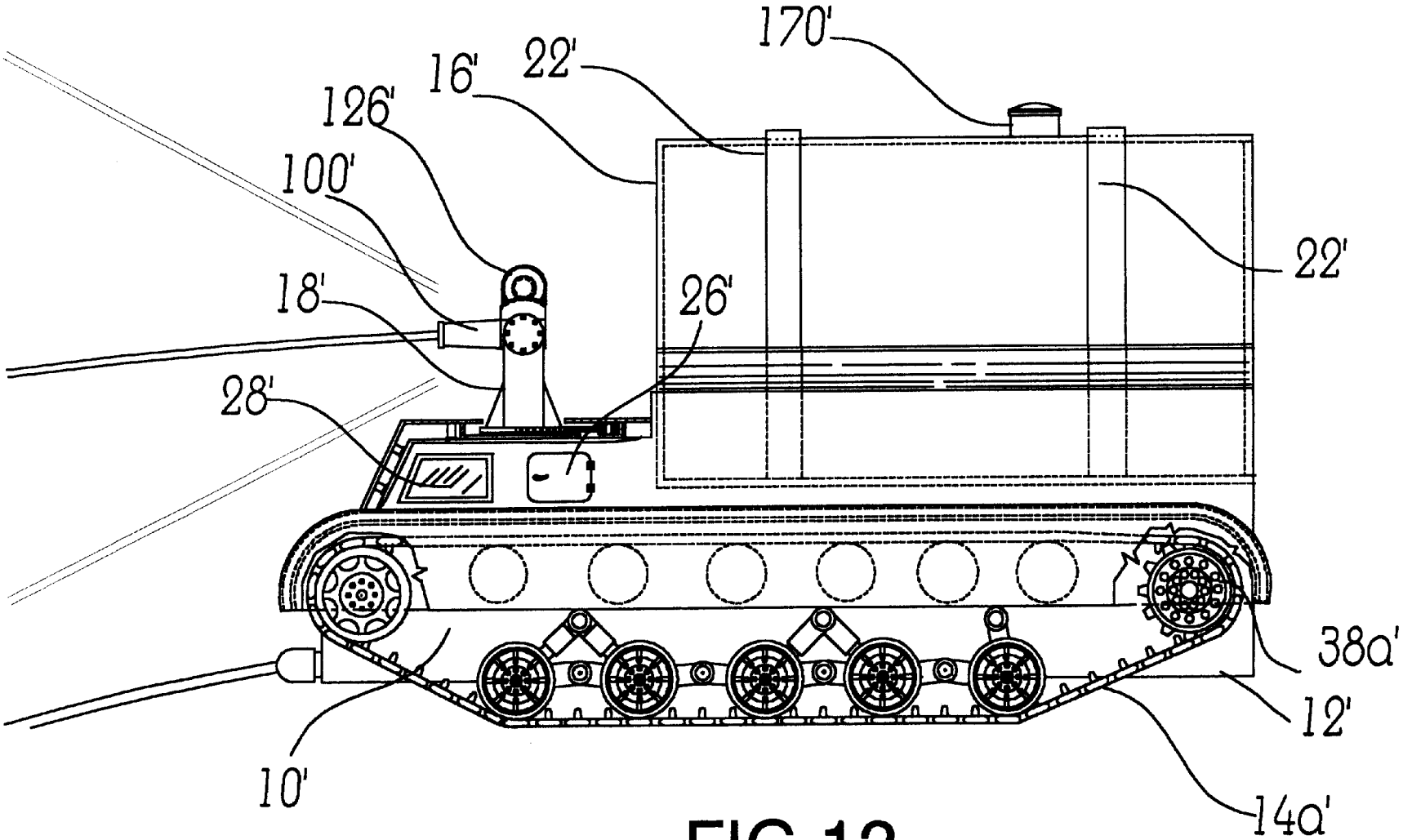
FIG. 12 is a simplified view of the fire fighting vehicle with an integral tank that must be filled while the vehicle is off station.

FIG. 12 is similar to FIG. 1 showing in elevation a similar fire fighting vehicle but having an integral tank 16' permanently fixed in place to the frame with permanent straps 22' securing the tank 16' to the vehicle. This vehicle otherwise has all the features of the removable tank embodiment. Some of the corresponding parts have been identified with the same number indicator with the addition of a prime thereto. It would require much more time off station to refill the permanently attached 6,000 gallon tank. To effectively fight a large fire, at least two vehicles of this type would be required to keep at least one vehicle working on the fire while the other vehicle is being refilled. On the other hand, where the purpose is to fight limited fires, a single vehicle would save the cost of a second vehicle plus the additional man power to operate and maintain that vehicle.

The above described fire fighting vehicle and its two embodiments represent a novel and viable way to effectively fight brush fires in California and ground fires elsewhere. The structures described to a large extent are representative and intended to provide an embodiment of a concept which should be more effective in fighting such fires than current methods. The embodiment employing removable tanks has considerable advantage, particularly when the vehicles are made identical with one another and the tanks are universally exchangeable. In areas where there is a frequent danger, permanent stations could be established for filling and exchange of tanks with hydrants and cradles in place. In some places it might even be worthwhile to have a permanent crane, although in most cases having a portable crane would be more cost effective. In locations where having a permanent installation is not practical, the filling cradles could be set up at a point near a water supply. With today's technology, lightweight frame cradles can be quickly put in place and be highly effective. Where municipal water supplies are not available it would be possible to carry pumping equipment to pump water from a river or lake, or even from the ocean, although use of salt water would be a last resort because of its corrosive effect upon the plumbing and the other parts.

So much of the structures shown are state of the art that it has been deemed unnecessary to describe such structures in great detail and one skilled in the art would know how to find the components necessary to construct a fire fighting vehicle in accordance with the invention or could readily find and employ such information in the public domain. However, the general overall configuration of the fire fighting vehicle including location of mainstream delivery nozzle and the use of a sprinkler for controlling fire beneath or close to the vehicle and the general configuration of how the structures would be arranged, is believed to be novel. Multiple nozzles could be employed, of course, and employing them at a fixed elevation or even at a fixed azimuth, either based upon a wider spray pattern from the nozzle or from greater maneuverability of a particular vehicle or like, is believed to be obvious to one skilled in the art and such modifications are intended to be within the scope of the invention. Likewise, the variations permitting the changes in height of the horizontal axis of rotation of the nozzle itself, while not illustrated, are deemed to be within the scope of the invention and the knowledge of the man skilled in the art.

Shapes of tanks employed and method of attachment and detachment are not material to the invention. Variations which permit automatic connection to the water tank, when properly positioned on the vehicle, as well as other types of coupling, and various modes of delivery of water to the various points of use are deemed to be within the skill of plumbers and other tradesmen. The use of fire fighting fluids other than water is considered an appropriate alternative within the scope of the invention. The use of a heat shield, or other cooling means for the operator compartment will find many variations. The specific embodiment shown is acknowledged to be one of many of the possible ways of performing a task considered to be within the scope of the invention. All structures and methods within the scope of the claims and reasonable equivalent hereof are deemed to be within the scope of the present invention.

I claim:

1. A fire fighting vehicle comprising, a frame, a drive system for the vehicle supported on the frame, tractor treads supported from the frame by support means including rotatable drive and idler supports, the rotatable drive supports being driven by the drive system through separately driven drive shafts connected to the drive system, power control means connected to and controlling power delivered to the drive system and the speed and direction of movement of the respective treads in response to vehicle positioning signals, a water storage tank supported on the frame, a high volume water nozzle, movable support means for the water nozzle on the frame, so as to permit redirection of the nozzle relative to the frame without changing vehicle position, drive means connected between relatively movable-parts of the movable support means to reposition the nozzle by driving the parts relative to one another, control means for powering and moving the drive means to enable desired nozzle positioning, a water conduit between the water storage tank and the water nozzle, and a remotely controlled valve in the water conduit responsive to command signals of need of water.

2. A fire fighting vehicle comprising, a frame, a drive system for the vehicle supported on the frame, tractor treads supported from the frame by support means including rotatable drive and idler supports, the rotatable drive supports being driven by the drive system through separately driven drive shafts connected to the drive system, an operating compartment for at least one occupant supported on the frame, power control means within the operating compartment, connected to and controlling power delivered to the drive system and the speed and direction of movement of the respective treads, a water storage tank supported on the frame, a high volume water nozzle, movable support means for the water nozzle on the frame, so as to permit redirection of the nozzle relative to the frame without changing vehicle position, drive means connected between relatively movable parts of the movable support means to reposition the nozzle by driving the parts relative to one another, control means in the operating compartment for the drive means for repositioning the water nozzle by driving the movable connection, a water conduit between the water storage tank and the water nozzle, a valve in the water conduit, and controls for opening and closing the valve in the water conduit in the operating compartment.

3. The fire fighting vehicle of claim 2 in which the frame is provided with a supporting cradle conforming to the storage tank and the tank is removable from the frame so that an empty tank may be removed and a full tank put in its place, and quick coupling connection is provided between the tank and the water conduit supported on the frame.

4. The fire fighting vehicle of claim 3 in which flexible connectors to secure a tank to the frame are quickly connectable to and releasable from around the tank.

5. The Fire fighting vehicle of claim 4 which the flexible connectors are straps fixed at one end to the frame of the vehicle brought together over the tank then connected together by cooperating members one of which includes a lever handle pivotally connected along a first axis to a support member at the end of one flexible strap and having one of the cooperating members engaging the other cooperating member on the other strap rotatably connected to the lever along a second axis parallel to the first axis but spaced from the first axis such that when the connection members are engaged, the lever can be moved about its first axis so that the second axis moves over center of the first axis in a toggle movement that will tighten the straps.

6. The fire fighting vehicle of claim 2 in which a fixed spray array is also supported on the frame to direct a distributed spray of water in front of the vehicle, a water spray conduit connecting the spray array to the tank.

7. The fire fighting vehicle of claim 2 in which heat shields to cover surfaces of the operating compartment and other parts of the frame exposed to fire and heat are supported from the covered surfaces by stand offs and water is distributed to designated positions behind the heat shields by a water distribution systems and applied to the back of the heat shields by a system of manifolds and conduits connected to the water tank, with at least one control valve in a main conduit controlling flow to the system having controls in the operating compartment.

8. A fire fighting vehicle comprising, a frame, a drive system for the vehicle supported on the frame, tractor treads supported from the frame by support means including rotatable drive and idler supports, the rotatable drive supports being driven by the drive system through separately driven drive shafts connected to the drive system, an operating compartment for at least one occupant supported on the frame, power control means within the operating compartment, connected to and controlling power delivered to the drive system and the speed and direction of movement of the respective treads, a water storage tank supported on the frame, a high volume water nozzle supported on the frame, movable support means for the water nozzle on the frame, so as to permit redirection of the nozzle relative to the frame without changing vehicle position, drive means connected between relatively movable parts of the movable support means to reposition the nozzle by driving the parts relative to one another, control means for powering and moving the drive means to enable desired nozzle positioning, a water conduit between the water storage tank and the water nozzle, a valve in the water conduit, and controls for opening and closing the valve in the water conduit in the operating compartment, controls for the nozzle positioning drive means in the operating compartment.

9. The fire fighting vehicle of claim 8 in which a fixed spray array is supported on the frame to direct a distributed spray in front of the vehicle, spray connections conduit connects the water storage tank and the fixed spray array and includes at least one spray control valve, and remote control for the spray control valve located in the operating compartment.

10. The fire fighting vehicle of claim 9 in which the high volume water nozzle is supported to rotate about a generally vertical axis relative the frame by a generally vertically oriented azimuth support structure, azimuth positioning structure to move the azimuth support structure and the supported nozzle around a vertical axis to selected positions, an inter-connecting nozzle elevation positioning structure between the azimuth support and the supported nozzle to permit rotation of the nozzle about a generally horizontal axis relative to the azimuth support structure, elevation positioning structure to move the elevation support structure and the supported nozzle relative to the azimuth support structure around a horizontal axis to a selected elevation position.

11. The fire fighting vehicle of claim 10 in which azimuth and elevation control structures, respectively, have hollow parts to provide part of the water conduit between the water tank and the nozzle and each has a rotating joint between its hollow parts with seals therebetween to permit flow of water through the conduit without leakage.

12. The fire fighting vehicle of claim 11 in which the relatively rotatable parts of the azimuth support structure and of the elevation support structure, respectively, are driven relative to one another by motor and gear linkages for rotatably repositioning those parts and control for the respective motors are positioned in the operating compartment close to the position of the person controlling.

13. The Fire fighting vehicle of claim 12 in which the tubular vertical water conduit snugly fits within a rotatably supported outer structure with sealing means between the relatively rotatable cylindrical surfaces thereof, and the outer structure is supported on coaxial bearings, in turn supported on the frame and extending through an opening in the ceiling of the operating compartment.

14. The Fire fighting vehicle of claim 13 in which the outer structure carries a radially extending coaxial gear segment fixed to the outer member to rotate with it, which gear segment is engaged with and driven by a pinion gear driven by a drive motor supported on the frame having an axis of rotation parallel to that of the outer structure.

15. The Fire fighting vehicle of claim 14 in which the outer structure rotatable about a vertical axis in turn supports a block through which an extension of the conduit extends and which rotates with the outer member movable about the vertical axis and provides bearing support for a snugly received generally horizontally arranged tubular support member for the nozzle, the ends of the tubular conduit closed and at least one slot opening in the tubular member into which the conduit through the supporting outer structure connects in all operable rotational positions of the generally horizontal tubular member and seals are provided between the horizontal tube and the outer structure on both sides of each slot, and a nozzle is fixed to the horizontal tube so that its flow passage connects wit the interior conduit of the tube and its elevation may be changed by rotation of the tube, and drive structure is provided between the outer structure and the horizontal tube and nozzle in order to produce relative rotation about a horizontal axis.

16. The Fire fighting vehicle of claim 15 in which the horizontal tubular member supports the nozzle as the tubular member passes through a gap between separated upper ends of the outer structure and bearings are provided at each end of the horizontal tubular member to rotatably support the horizontal tubular member outside of the outside seals.

17. The Fire fighting vehicle of claim 13 in which the conduit in the outer structure is formed in a "Y"shape; the horizontal tubular member is provided with radial slot openings allowing continuance flow into it the horizontal tubular member in any operational rotational position from the each of the channels of the y, seals are provided in each of the Y-branches on each side of the conduit branches and the slot openings and the nozzle has its nozzle passage connected to the horizontal tubular member to deliver water to the nozzle from the conduit.

18. The fire fighting vehicle of claim 16 in which a gear segment is fixed to the horizontal tube to move with it and drive the tube to allowable operating positions by an engaging pinion gear on the horizontal shaft of a motor mounted on the supporting outer structure.

19. The fire fighting vehicle of claim 18 in which the stand offs for the heat shields are themselves conduits connected into the water distribution system and provided with spray openings directing water to the back of the heat shield they support.

20. The Fire fighting vehicle of claim 18 in which heat shields are provided at least on the front of the operating compartment as well as the top and sides thereof.

21. The Fire fighting vehicle of claim 19 in which at least one window for the operators is provided in the operating compartment through the compartment forward wall and the heat shield, each window having heat resistant light transmitting but heat retarding materials for each window.

22. A fire fighting vehicle comprising, a frame, a drive system for the vehicle supported on the frame, tractor treads supported from the frame by support means including rotatable drive and idler supports, the rotatable drive supports being driven by the drive system through separately driven drive shafts connected to the drive system, power control means connected to and controlling power delivered to the drive system and the speed and direction of movement of the respective treads in response to vehicle positioning signals, a water storage tank supported on the frame, a high volume water nozzle supported on the frame, a water conduit between the water storage tank and the water nozzle, and a remotely controlled valve in the water conduit between the water storage tank and the water nozzle responsive to command signals of need for water, a fixed spray array also supported on the frame to direct a distributed spray of water in front of the vehicle, a spray water conduit connecting the spray array to the tank, and a remote controlled spray valve in the spray water conduit responsive to command signals of the need for spray water.

* * * * *